US008267846B2

(12) United States Patent
Yang

(10) Patent No.: US 8,267,846 B2
(45) Date of Patent: Sep. 18, 2012

(54) EXERCISE WHEEL

(76) Inventor: Lien-Chuan Yang, Taipei (TW)

( * ) Notice: Subject to any disclaimer, the term of this patent is extended or adjusted under 35 U.S.C. 154(b) by 78 days.

(21) Appl. No.: 13/014,071

(22) Filed: Jan. 26, 2011

(65) Prior Publication Data

US 2011/0183824 A1 Jul. 28, 2011

(30) Foreign Application Priority Data

Jan. 28, 2010 (TW) ..... 99201771 U

(51) Int. Cl.
*A63B 21/00* (2006.01)
*B62K 1/00* (2006.01)

(52) U.S. Cl. ..... 482/140; 280/221; 482/132

(58) Field of Classification Search ..... 482/51, 482/66, 68, 92, 132; 280/221
See application file for complete search history.

(56) References Cited

U.S. PATENT DOCUMENTS 3,190,675 A * 6/1965 Tang ..... 280/221
3,403,906 A * 10/1968 Burzenski ..... 482/132
3,752,475 A * 8/1973 Ott ..... 482/127
4,339,127 A * 7/1982 Mitchell ..... 482/132
4,786,067 A * 11/1988 Tang ..... 280/221
4,786,068 A * 11/1988 Tang ..... 280/221
4,786,069 A * 11/1988 Tang ..... 280/221
5,011,171 A * 4/1991 Cook ..... 280/221
D454,929 S * 3/2002 Huang ..... D21/662
6,837,833 B2 * 1/2005 Elledge ..... 482/108
7,837,603 B1 * 11/2010 Carnell, Sr. ..... 482/132

* cited by examiner

*Primary Examiner* — Stephen Crow
(74) *Attorney, Agent, or Firm* — Muncy, Geissler, Olds & Lowe, PLLC

(57) ABSTRACT

An exercise wheel is provided. The exercise wheel includes a wheel, a first support bar, and a second support bar, wherein a support portion is formed inside the wheel, and the support portion includes a first surface and a second surface opposite to the first surface; an end of the first support bar is connected to the support portion, and the other end vertically extends outwardly in a direction away from the first surface; the second support bar and the first support bar are symmetrical about a center of the wheel, an end of the second bar is connected to the support portion, and the other end vertically extends outwardly in a direction away from the second surface; therefore, when holding the first and second support bars with two hands, a user can drive the wheel in a mode of riding a bicycle, so a body of the user moves forward and backward, so as to work muscles of an upper part of the body.

7 Claims, 2 Drawing Sheets

EXERCISE WHEEL

BACKGROUND OF THE INVENTION

1. Field of Invention

The present invention relates to an exercise wheel, more particularly to an exercise wheel with a wheel having support bars disposed at two sides thereof respectively, and the two support bars are symmetrical about a center.

2. Related Art

Currently, a common commercially available exercise wheel mainly includes a housing, a straight rod passing through the housing, a linkage structure, and one or two wheels. When the straight rod passes through the housing, a grip is respectively formed at two sides of the housing, so when a user leans forward and holds the grips at two sides of the housing with two hands respectively, the user may push forward or pull backward on the ground. When the user pushes forward to the utmost, the body almost approaches the ground completely, and when the user pulls backward to the utmost, the upper part and the lower part of the body nearly overlap. In this way, the user is able to work the waist, so as to achieve an exercise effect.

However, effects of the sports and exercises achieved in the mode that the user simply pushes the wheel forward or pulls the wheel backward on the ground to work the waist are limited, and improvement can still be made.

In view of this, in order to provide a structure different from the conventional exercise wheel and eliminate the above defects, so when a user rotates a wheel forward or backward, the exercise wheel can provide exercises for multiple parts of the body, thereby achieving multiple effects of sports and exercises, the inventor makes the present invention with years of experiences after continuous research, development, and improvement.

SUMMARY OF THE INVENTION

The primary object of the present invention is to provide an exercise wheel with a structure in which a support bar is respectively disposed at two sides of a wheel and the two support bars are symmetrical about a center that a user can move the body forward or backward when driving the wheel in a mode of riding a bicycle. In the process that the user prevents the wheel from falling to a side, muscles of the upper part of the body are exercised, and the fun of use may occur, so as to improve an exercise effect.

Another object of the present invention is to provide an exercise wheel with a structure in which a shaft hole is disposed at a center of a wheel and two support bars symmetrical about the center are respectively disposed at two sides of the wheel that a user can select to drive the wheel in a mode of riding a bicycle or in a mode of a conventional exercise wheel to drive the wheel, so the exercise wheel is very flexible in use.

In order to achieve the above objectives, the exercise wheel of the present invention includes a wheel, a first support bar, and a second support bar. A support portion is formed inside of the wheel and includes a first surface and a second surface opposite to the first surface. An end of the first support bar is connected to the support portion, and the other end vertically extends outwardly in a direction away from the first surface. The second support bar and the first support bar are symmetrical about a center of the wheel, an end of the second support is connected to the support portion, and the other end vertically extends outwardly in a direction away from the second surface.

In practice, the first support bar includes a first inner tube and a first grip, in which the first inner tube passes through the support portion, and the first grip is sleeved over the first inner tube. The second support bar includes a second inner tube and a second grip, in which the second inner tube passes through the support portion, and the second grip is sleeved over the second inner tube.

In practice, a shaft hole is formed at the center of the wheel.

Other objects, advantages and novel features of the present invention will become more apparent from the following detailed description when taken in conjunction with the accompanying drawings.

DETAILED DESCRIPTION OF THE INVENTION

Figure 1:
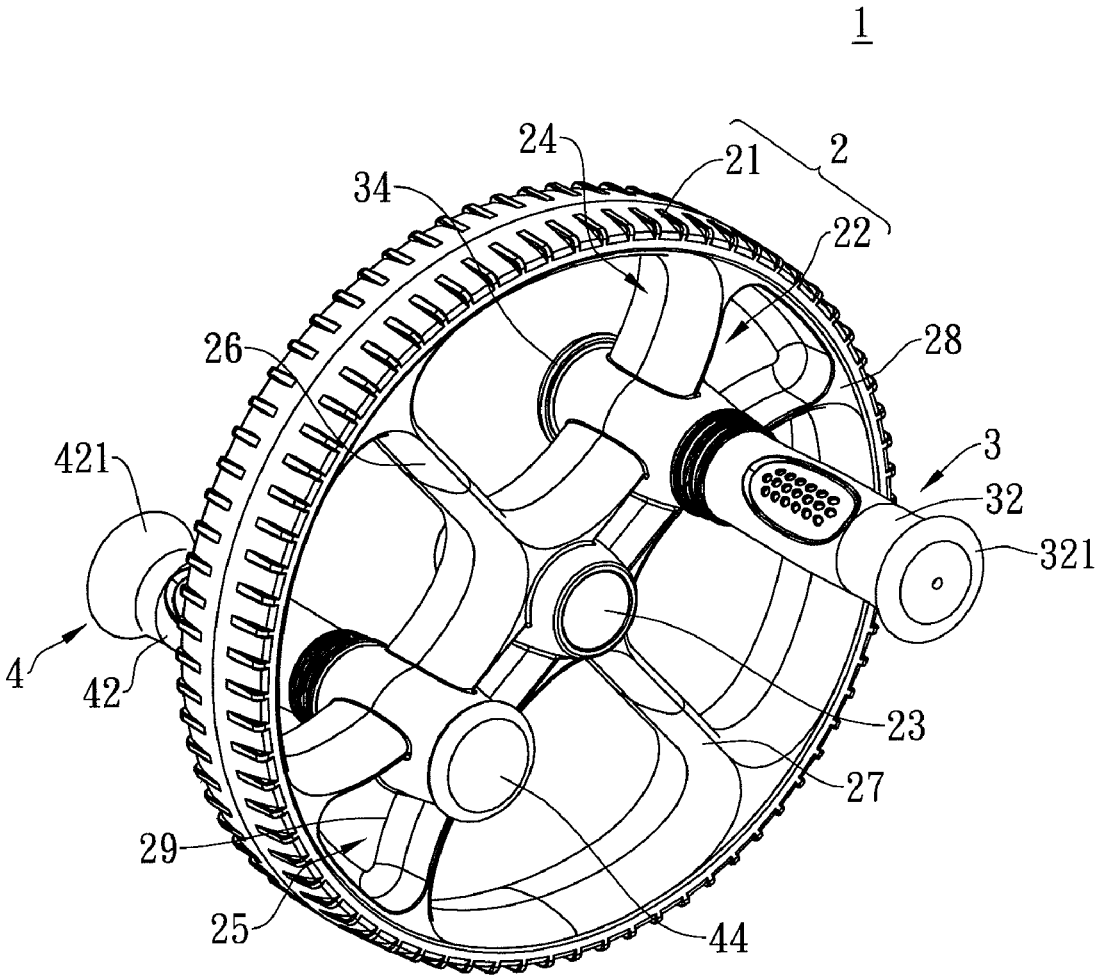
FIG. 1 is a schematic view of an exercise wheel according to a preferred embodiment of the present invention.
Figure 2:
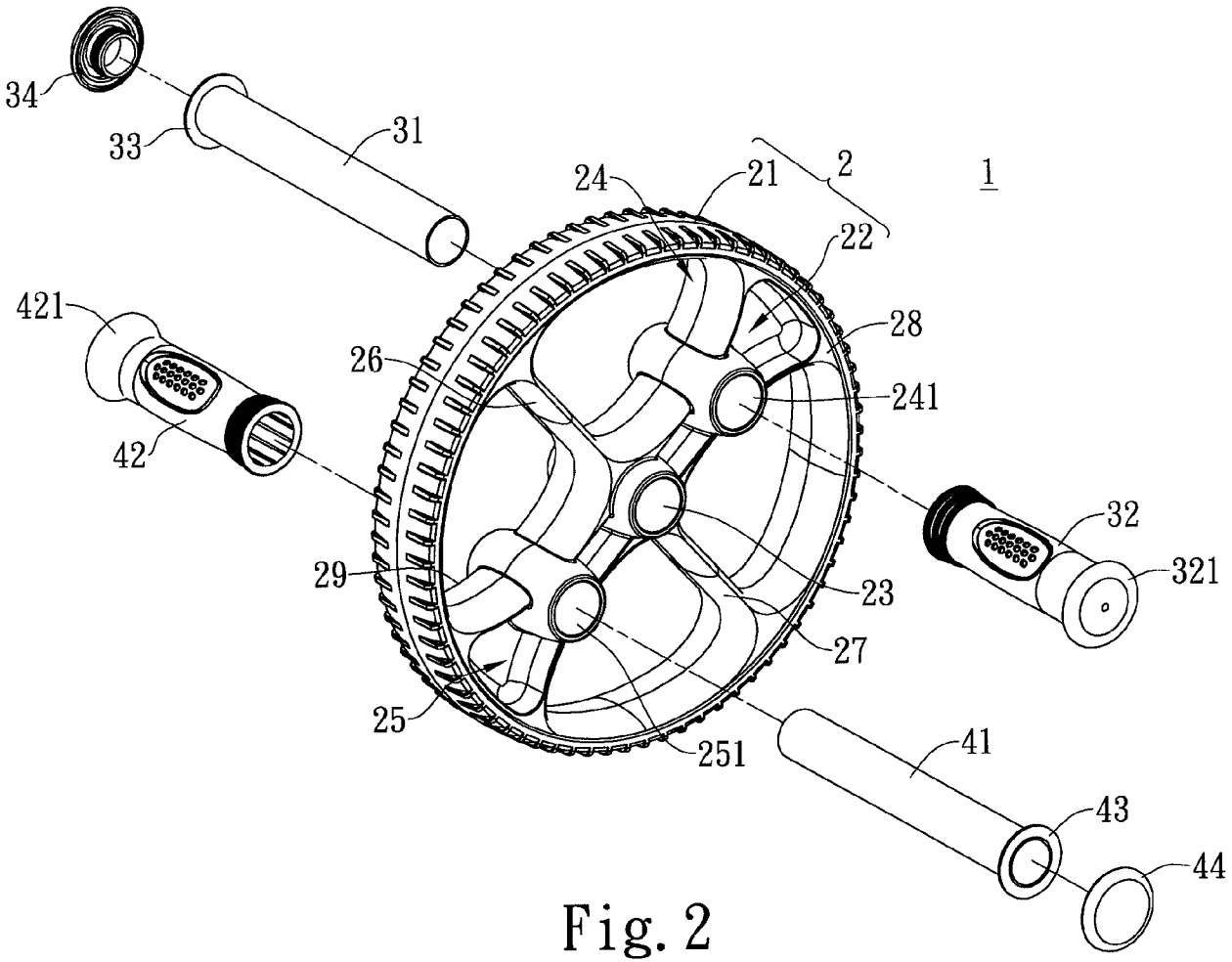
FIG. 2 is an exploded view of an exercise wheel according to a preferred embodiment of the present invention.

FIGS. 1 and 2 show an exercise wheel 1 according to a preferred embodiment of the present invention. The exercise wheel 1 includes a wheel 2, a first support bar 3, and a second support bar 4.

The wheel 2 includes an outer wheel 21 and a support portion 22. The outer wheel 21 is made of a soft plastic material, and the outer wheel 21 is joined with a periphery of the support portion 22. The support portion 22 is made of a rigid plastic material, and a shaft hole 23 is formed at a center of the support portion 22. The support portion 22 includes a group of a first positioning rib group 24 and a second positioning rib group 25 symmetrical about the shaft hole 23 and another group of a first support rib 26 and a second support rib 27 symmetrical about the shaft hole 23, in which the first and second positioning rib groups (24, 25), and the first and second support ribs (26, 27) are disposed in an interlaced form. A circular first perforation 241 is opened on the first positioning rib group 24, and a circular second perforation 251 is opened on the second positioning rib group 25, in which the first perforation 241 and the second perforation 251 are symmetrical about the shaft hole 23 of the support portion 22. Furthermore, a first surface 28 and a second surface 29 opposite to the first surface 28 are formed at two sides of the support portion 22.

The first support bar 3 includes a first inner tube 31 and a first grip 32, in which the first inner tube 31 is a straight circular tube, and an end thereof is joined with an annular sheet. An external diameter of the sheet is greater than an external diameter of the first inner tube 31, and the sheet serves as a first stop portion 33. An end of a first cap 34 is sleeved in the first inner tube 31, so as to cover the first stop portion 33. During assembly, the first inner tube 31 passes through the first perforation 241 in a direction from the second surface 29 of the support portion 22 towards the first surface 28. After the first inner tube 31 passes through the first perforation 241, the first grip 32 is sleeved over the first inner tube 31, so an end of the first support bar 3 is firmly connected to the support portion 22, and the other end of the first support bar 3 vertically extends outwardly in a direction away from the first surface 28.

The second support bar 4 includes a second inner tube 41 and a second grip 42, in which the second inner tube 41 is a straight circular tube, and an end thereof is joined with an annular sheet. An external diameter of the sheet is greater than an external diameter of the second inner tube 41, and the sheet serves as a second stop portion 43. An end of a second cap 44 is sleeved in the second inner tube 41, so as to cover the second stop portion 43. During assembly, the second inner tube 41 passes through the second perforation 251 in a direction from the first surface 28 of the support portion 22 towards the second surface 29. After the second inner tube 41 passes through the second perforation 251, the second grip 42 is sleeved in the second inner tube 41, so an end of the second support bar 4 is firmly connected to the support portion 22, and the other end of the second support bar 4 vertically extends outwardly in a direction away from the second surface 29, and the second support bar 4 and the first support bar 3 are symmetrical about the center of the wheel 2.

According to this, when the user holds the first and second support bars (3, 4) at two sides of the wheel 2 with two hands respectively, the user can drive the wheel 2 in a mode of riding a bicycle, so an upper part of the body of the user moves forward or backward to work muscles of the upper part of the body. When the first and second support bars (3, 4) are dismantled and a straight rod passes through the shaft hole 23 of the support portion 22, the exercise wheel 1 may be used as a normal exercise wheel.

In practice, an end of the first grip 32 away from the first surface 28 is disposed with a first arc barrier portion 321, and an end of the second grip 42 away from the second surface 29 is disposed with a second arc barrier portion 421. According to this, when the user rotates the wheel 2 forward or backward, the wheel 2 is prevented from leaning to a side to hurt the hands.

Therefore, the present invention has the following advantages:

1. According to the present invention, the user can drive the wheel in a mode of riding a bicycle, so the upper part of the body moves forward or backward, and in the process of driving the wheel, the user has to keep balance of the body to prevent the wheel from leaning to a side. Therefore, a sense of balance may be effectively trained, muscles of the upper part of the body are exercised, and the fun of use may occur, so as to improve an exercise effect.

2. According to the present invention, the user not only can select to drive the wheel in a mode of riding a bicycle, but also can select to drive the wheel in a mode of a conventional exercise wheel, so the present invention is very flexible in use.

3. According to the present invention, an arc barrier portion is respectively disposed on the first grip and the second grip, so when the user rotates the wheel forward or backward, the wheel is effectively prevented from leaning to a side to hurt the hands, so as to ensure use safety.

In conclusion, according to the disclosure above, the present invention can achieve expected objectives by providing an exercise wheel, so when the user rotates the wheel forward or backward, the exercise wheel can provide exercises for multiple parts of the body, thereby achieving multiple effects of sports and exercises, the use safety is ensured, and also, different sport modes may be adopted according to requirements of the user. Therefore, the present invention has industrial applicability, and thus, the application for a patent is filed according to the law.

While the present invention has been described with reference to the embodiments and technical means thereof, various changes and modifications can be made based on the disclosure or teachings described herein. Any equivalent changes made based on the concepts of the present invention having their effect without departing from the spirit encompassed by the specification and drawings should be construed as falling within the scope of the invention as defined by the appended claims.

It should be understood that different modifications and variations could be made from the disclosures of the present invention by the people familiar in the art without departing the spirit of the present invention.

What is claimed is:

1. An exercise wheel, comprising: a wheel, wherein a support portion is formed inside the wheel, and the support portion comprises a first surface and a second surface opposite to the first surface; a first support bar, wherein an end of the first support bar is connected to the support portion, and the other end horizontally extends outwardly in a direction away from the first surface; and a second support bar, wherein the second support bar and the first support bar are symmetrical about a center of the wheel, an end of the second support bar is connected to the support portion, and the other end horizontally extends outwardly in a direction away from the second surface, wherein a shaft hole is formed at a center of the wheel for supporting a straight exercise rod.

2. The exercise wheel according to claim 1, wherein the support portion comprises a plurality of ribs symmetrical about the center of the wheel, and the ribs are respectively connected to the first support bar and the second support bar.

3. The exercise wheel according to claim 1, wherein the wheel further comprises an outer wheel, and the outer wheel is joined with a periphery of the support portion.

4. The exercise wheel according to claim 1, wherein the first support bar comprises a first inner tube and a first grip, the first inner tube passes through the support portion, and the first grip is sleeved over the first inner tube.

5. The exercise wheel according to claim 4, wherein a first stop portion is disposed at an end of the first inner tube.

6. The exercise wheel according to claim 1, wherein the second support bar comprises a second inner tube and a second grip, the second inner tube passes through the support portion, and the second grip is sleeved over the second inner tube.

7. The exercise wheel according to claim 6, wherein a second stop portion is disposed at an end of the second inner tube.

* * * * *